US007104753B2

(12) United States Patent
Eubank et al.

(10) Patent No.: US 7,104,753 B2
(45) Date of Patent: Sep. 12, 2006

(54) MOTOR FAN GUARD

(75) Inventors: Gerry E. Eubank, Arlington, TX (US); Paul S. Komisarz, Saginaw, TX (US)

(73) Assignee: Dreison International, Inc., Cleveland, OH (US)

( * ) Notice: Subject to any disclaimer, the term of this patent is extended or adjusted under 35 U.S.C. 154(b) by 65 days.

(21) Appl. No.: 10/889,679

(22) Filed: Jul. 13, 2004

(65) Prior Publication Data

US 2006/0013694 A1 Jan. 19, 2006

(51) Int. Cl.
*F04D 29/70* (2006.01)

(52) U.S. Cl. ..... 415/121.2; 416/247 R

(58) Field of Classification Search ..... 416/247 R; 415/121.2; 248/49, 603, 903; D23/324, D23/381, 382, 385
See application file for complete search history.

(56) References Cited

U.S. PATENT DOCUMENTS 3,963,382 A * 6/1976 Patton ..... 416/247 R
5,131,352 A 7/1992 Hoshino et al.
5,215,438 A 6/1993 Chou et al.
5,394,039 A 2/1995 Suchdev et al.
5,460,485 A 10/1995 Sugiyama et al.
5,660,367 A * 8/1997 Rush ..... 248/674
6,017,191 A 1/2000 Harmsen
6,045,327 A 4/2000 Amr
6,099,258 A 8/2000 Litvin et al.
6,139,265 A 10/2000 Alizadeh
6,142,733 A 11/2000 Alizadeh et al.
6,263,980 B1 7/2001 Wadge
6,443,714 B1 * 9/2002 Hollenbeck et al. ..... 417/423.1
6,494,430 B1 * 12/2002 Takakura ..... 248/603
6,554,230 B1 * 4/2003 Horski ..... 248/49

* cited by examiner

*Primary Examiner*—Igor Kershteyn
(74) *Attorney, Agent, or Firm*—Fay, Sharpe, Fagan, Minnich & McKee, LLP

(57) ABSTRACT

The present invention relates to a fan guard which utilizes an associated electric motor body for increased support and rigidity. The fan guard includes an inner housing member which mounts to an electric motor body. A plurality of circumferentially spaced reinforcing ribs is each connected at an inner end to the inner housing member. Each reinforcing rib extends radially outward therefrom. A plurality of spaced fan guard ribs is connected at an inner end to the inner housing member and extends radially outward therefrom. A rim extends circumferentially around the plurality of fan guard ribs and is connected to an outer end of each of the fan guard ribs.

31 Claims, 4 Drawing Sheets

MOTOR FAN GUARD

BACKGROUND OF THE INVENTION

The present invention relates to fans. More particularly it pertains to a fan guard which utilizes an associated electric motor body for increased support and rigidity.

Many types of electric fans are known. One particular type of fan used in a vehicle is alternatively known as a dash fan, defroster fan or universal fan. In the prior art, it is well known that such fans commonly mount the fan guard and fan blades to the electric motor. The weight of these components is typically transferred to a spring loaded pivoting ball by way of a bracket (commonly known as a yoke) thereby allowing an operator to rotate the fan relative to a base or pedestal in order to control the direction of the air stream. The pivoting ball is housed in a mating slot and socket and the pivoting feature of the electric fan is limited to the travel within the slotted pathway. Generally, the force required to rotate the electric fan relative to this pivoting arrangement exceeds the vibrational force exerted on the electric fan by the movement of a vehicle. The fan guard is generally secured to the electric motor by motor assembly bolts (commonly referred to as case bolts) which also secure the motor assembly to the base or pedestal.

One problem with conventional electric fans as described above is the failure of the fan blades. Such failure generally occurs when the fan is mounted in such a way that it is prevented from traveling in the slotted pathway. In these instances, in order to obtain the desired travel, an operator will either grasp the top of the fan guard and force the pedestal on which the electric fan is mounted against the top of the slot thereby effectively creating a fulcrum or grasp the top and bottom of the fan guard simultaneously thereby creating a secondary rotational force through a plane not defined by the fan guard motor assembly bolts. Prior to the present invention, pressing of the fan guard at any location other than the plane defined by the motor assembly bolts would deflect the fan guard. As a result of this deflection, the fan guard may contact the fan blades causing the fan blades to fail. In these instances, the fan assembly needs to be replaced, and an operator is exposed to a potentially unsafe condition.

Accordingly, it has been considered desirable to develop a fan guard which would overcome the foregoing failure. The resulting new design improves the durability, rigidity and strength of the fan guard such that an operator can press on the fan guard at any location and not deflect the fan guard without excessive force.

SUMMARY OF THE INVENTION

In accordance with one aspect of the present invention, a new and improved fan guard which utilizes an electric motor body for increased support and rigidity is provided.

More particularly, in accordance with this aspect of the present invention, the fan guard comprises an inner housing member which mounts to an electric motor body. A plurality of circumferentially spaced reinforcing ribs is connected at an inner end to the inner housing member. Each reinforcing rib extends radially outward therefrom. A plurality of spaced fan guard ribs is connected at an inner end to the inner housing member and extends radially outward therefrom. A rim extends circumferentially around the plurality of fan guard ribs and is connected to an outer end of each of the fan guard ribs.

In accordance with another aspect of the present invention, the fan guard assembly comprises an inner housing member which includes a radially extending flange for mounting to an electric motor body. A plurality of circumferentially spaced reinforcing ribs is connected at an inner end to the inner housing member. Each reinforcing rib extends radially outward from the inner housing member. A plurality of spaced fan guard ribs is connected at an inner end to at least one of the reinforcing ribs and the inner housing member. A rim extends circumferentially around the plurality of fan guard ribs and is connected to an outer end of each of the fan guard ribs. The rim includes a first portion which extends radially from the outer end of each of the fan guard ribs and a second portion which extends axially from a distal end of the first portion. The first and second portions together form a generally L-shaped channel dimensioned to receive a fan grill.

In accordance with still another aspect of the present invention, the fan guard comprises an inner housing member having a crescent-shaped portion sized to encompass at least a portion of the electric motor body and a radially extending flange. A plurality of circumferentially spaced reinforcing ribs is connected at an inner end to the inner housing member. Each reinforcing rib extends radially outward from the inner housing member. A plurality of spaced fan guard ribs is connected at an inner end to at least one of the reinforcing ribs and the inner housing member.

In accordance with yet another aspect of the present invention, the fan guard comprises a generally semi-circular inner housing member sized to encompass and slidingly and axially receive at least a portion of the electric motor body. The inner housing member includes a radially extending circular flange having at least one mounting aperture adapted to receive a fastener to secure the radial flange to the motor body. A plurality of circumferentially spaced generally flattened reinforcing ribs is connected at an inner end to the inner housing member. Each reinforcing rib extends radially outward from the inner housing member. A plurality of spaced fan guard ribs is connected at an inner end to at least one of the reinforcing ribs and the inner housing member. A rim extends circumferentially around the plurality of fan guard ribs and is connected to an outer end of each of the fan guard ribs. The rim is axially spaced from the inner housing member.

Still other aspects of the invention will become apparent from a reading and understanding of the detailed description of the preferred embodiment hereinbelow.

BRIEF DESCRIPTION OF THE DRAWINGS

The present invention may take physical form in certain parts and arrangements of parts, a preferred embodiment of which will be described in detail in this specification and illustrated in the accompanying drawings which form a part of the invention.

DETAILED DESCRIPTION OF THE PREFERRED EMBODIMENT

It should, of course, be understood that the description and drawings herein are merely illustrative and that various modifications and changes can be made in the structures disclosed without departing from the spirit of the invention. Like numerals refer to like parts throughout the several views.

Figure 1:
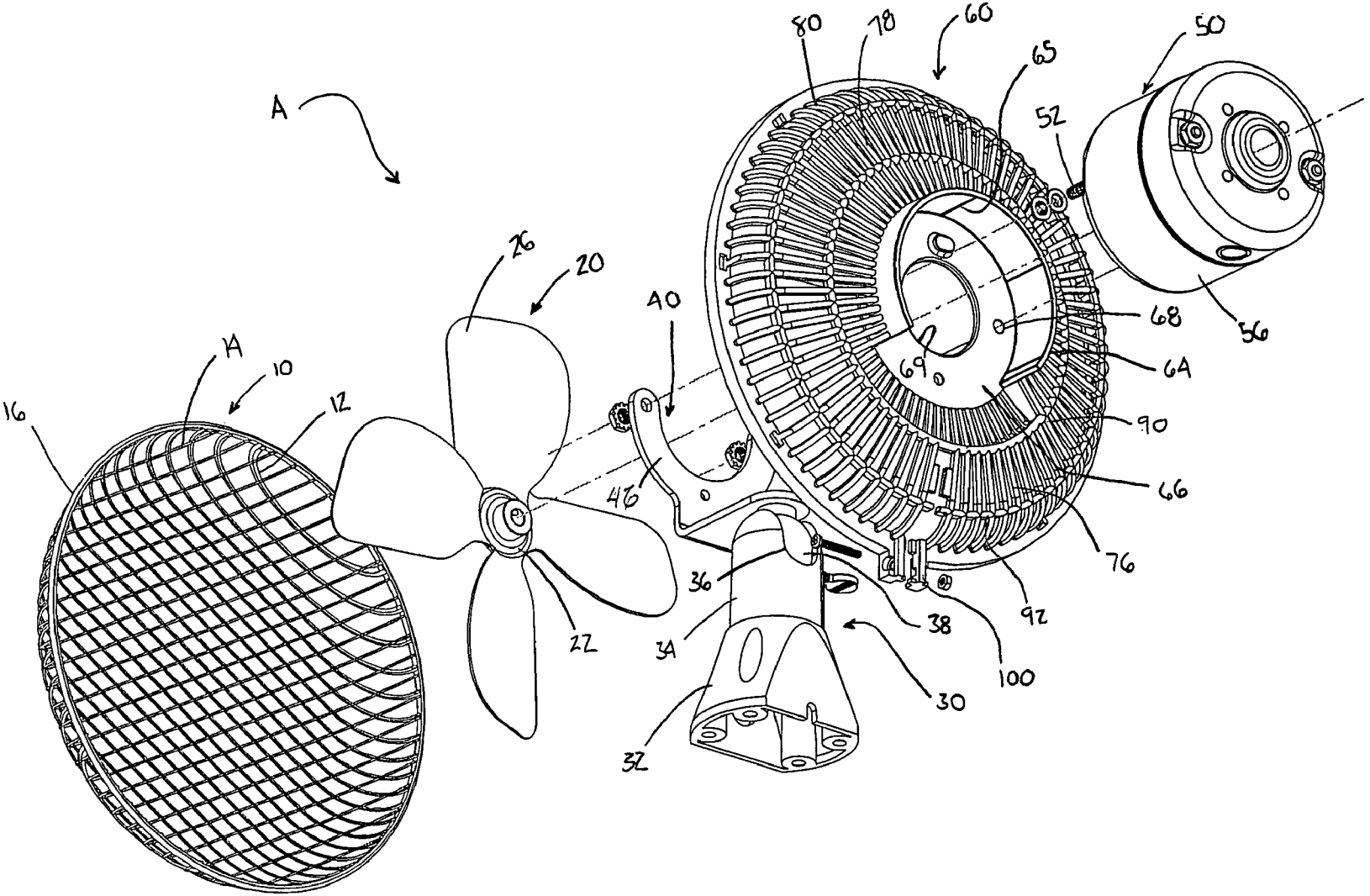
FIG. 1 is an exploded rear perspective view of a fan assembly according to the present invention.
Figure 2:
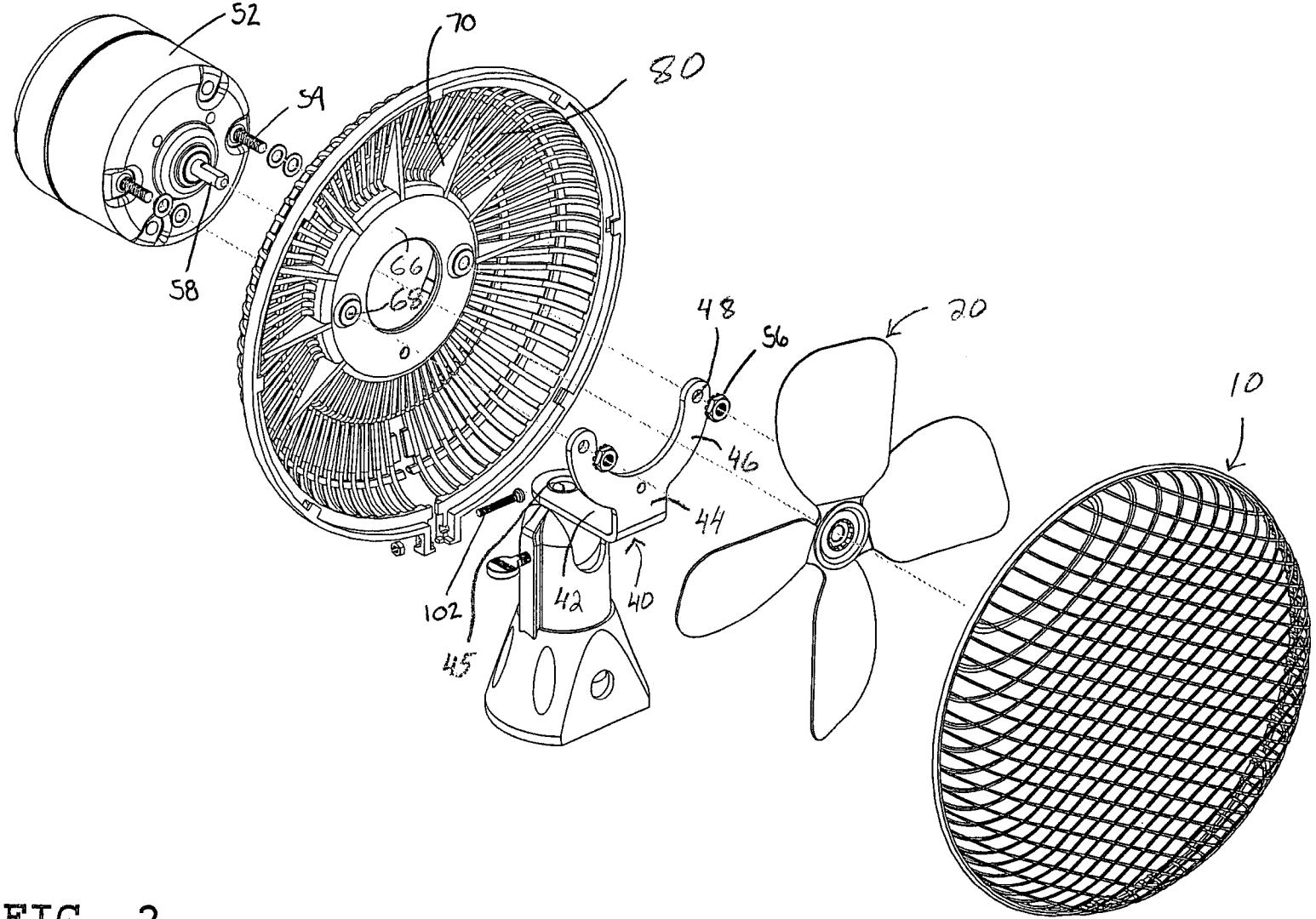
FIG. 2 is an exploded front perspective view of the fan assembly of FIG. 1.

Referring now to the drawings, wherein the showings illustrate a preferred embodiment of the invention only and are not intended to limit same, FIGS. 1 and 2 show an electric fan A in accordance with the preferred embodiment of the invention. While the embodiment is illustrated as a dash fan, defroster fan or universal fan for the passenger compartment of a vehicle, it should be appreciated that the invention can be adapted for a wide variety of other fan environments as well. Thus, the fan guard disclosed herein could be used in fans employed in a variety of non-vehicular environments. The fan guard assembly generally includes a fan grill 10, a fan blade assembly 20, a mounting assembly 30, an electric motor 50 and a fan guard 60.

With continued reference to FIGS. 1 and 2, the fan grill 10 can be of a generally dish-like configuration comprising a plurality of evenly spaced arcuate, transverse ribs 12 and 14. The ribs 12 and 14 generally form a grid-like pattern which protects the fan blade assembly 20 from foreign objects and prevents contact with the rotating fan blades. The fan grill 10 further includes an outer rim 16 extending circumferentially around the plurality of ribs 12 and 14 and is connected to each end of each of the ribs. In one embodiment, the fan grill 10 can comprise an expanded metal material with a wire rim 16 welded circumferentially around the ribs 12 and 14. But, it should be noted that other composite or hard materials may be used. Likewise, the configuration of the fan grill 10 depends on the requirements needed for the end use of the electric fan.

The fan blade assembly 20 can comprise a centrally positioned boss commonly known as a hub 22 having a central aperture. A plurality of fan blades 26 is circumferentially disposed about the boss 22 and extends radially therefrom, each blade having an inner end connected to the boss. The boss of the fan blade assembly 20 is attached to the electric motor 50 in a manner well known in the art. While a four blade fan is shown, there are, of course, many known fan blade arrangements in addition to the type illustrated in FIGS. 1 and 2.

Figure 3:
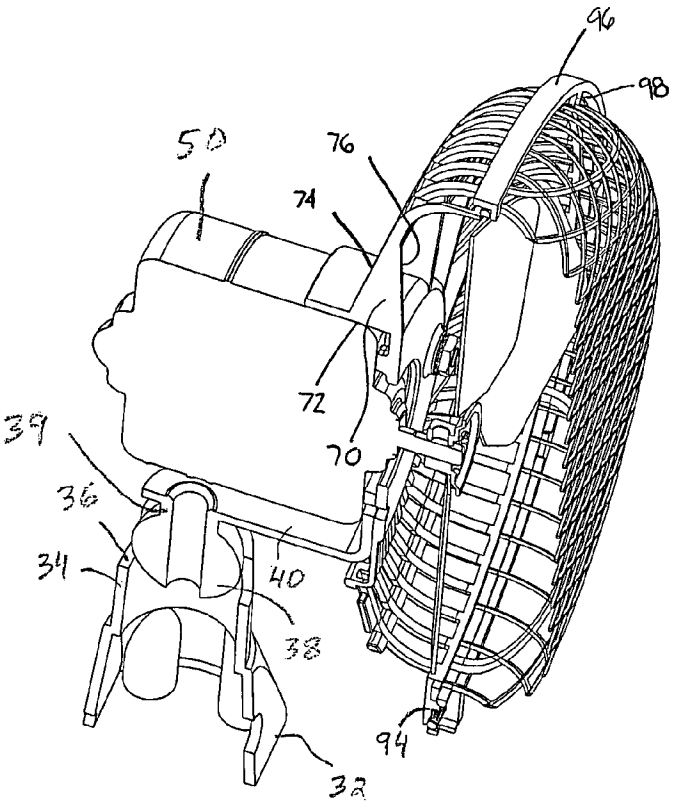
FIG. 3 is a perspective view, partially broken away, of the fan assembly of FIG. 1 in an assembled form.

With reference now also to FIG. 3, the mounting assembly 30 comprises a base or pedestal 32 for mounting the electric fan to a surface. A socket 34 is secured to the top surface of the base 32 and includes a slot 36. A spring loaded pivoting ball 38 is housed in the slot and socket and includes an outwardly projecting stem 39. The pivoting ball 38 allows an operator to control the direction of the air stream. The pivoting feature of the electric fan A is limited to the travel of the pivoting ball 38 within the mating slot 36. A bracket or yoke 40 secures the mounting assembly 30 to the electric motor 50.

As best shown in FIG. 2, the bracket 40 can be somewhat L-shaped and includes a first portion 42 and a second portion 44, extending approximately normal thereto. The first portion 42 includes a first end having an aperture 45 adapted to receive the stem 39 of the pivoting ball 38 and a second end attached to the second portion 44. The second portion 44 includes a pair of spaced arms 46 having mounting apertures 48 adjacent one end for securing the bracket 40 to the electric motor 50. As is evident, a somewhat Y-shaped structure is thus provided.

The electric motor 50 is of a conventional type having a circular body 52 and is provided with threaded motor assembly bolts or case bolts 54. Two are shown, which are intended to be engaged in the mounting apertures 48 of the extending arms 46 and retained thereto by nuts 56. The electric motor 50 is also provided with an output shaft 58 to which to which the boss 22 of the fan blade assembly 20 is attached.

Figure 6:
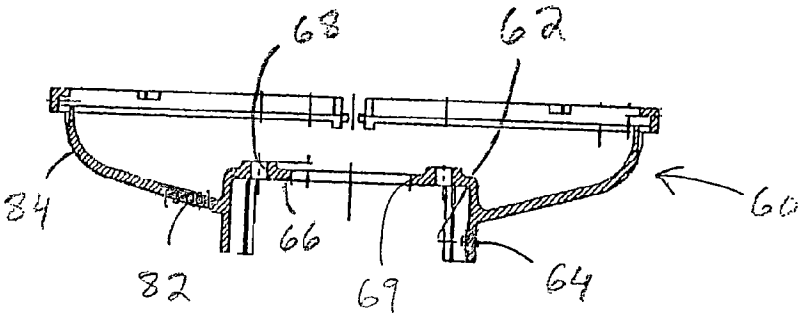
FIG. 6 is top cross sectional view of the fan guard of FIG. 4.

With reference now to FIG. 6, the fan guard 60 can also be dish-shaped. It comprises an inner housing member 62. Preferably, the inner housing member 62 includes a first axially extending flange 64 which slides over a portion of the electric motor body 52. The axially extending flange 64 is generally semicircular or crescent-shaped, as best shown in FIG. 1, and extends through an arc greater than one hundred eighty degrees (180°). By having the axial flange encompass a portion of the motor body, the flexural forces exerted on the fan guard 60 by an operator grasping the fan guard are limited by the motor body. To further enhance the strength and rigidity of the inner housing member 62, axially extending crush ribs or flats 65 are formed on an inner surface of the axial flange. The crush ribs, which can be spaced from each other, provide an interference fit with the electric motor body 52 and insure positive contact with the motor body. Thus, the crush ribs positively transfer flexural stresses to the electric motor body 52. Generally, the crush ribs 65 have a width of at least two thousandths of an inch, preferably between two and twenty thousandths of an inch, and a sufficient height to insure frictional contact with the motor body 52. However, it can be appreciated by one skilled in the art that the width and height of the crush ribs may be of any suitable size depending on the relative sizes of the inner housing member and the electric motor body.

The inner housing member 62 further includes a second flange 66 extending radially from one end of the axial flange 64. The radial flange 66 includes at least one mounting aperture 68 adapted to receive a motor assembly bolt 54 for securing the inner housing member 62 to the electric motor body 52. It also includes a central aperture 69 through which the motor output shaft 58 extends, as shown in FIG. 3.

Figure 5:
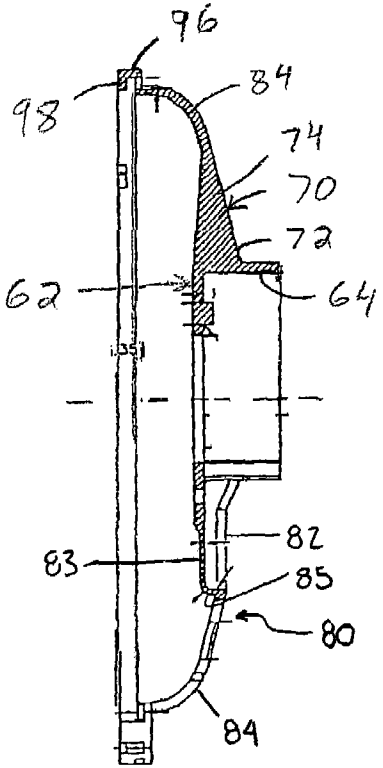
FIG. 5 is a cross-sectional view of the fan guard of FIG. 4, taken generally along the lines 5—5 of FIG. 4.

With reference again to FIG. 2, the fan guard 60 includes a plurality of circumferentially spaced reinforcing ribs 70 connected at an inner end to the inner housing member 62. Each reinforcing rib 70 extends radially outward from the inner housing member. With particular reference to FIG. 5, each reinforcing rib 70 includes a first portion 72 connected to and contiguous with a portion of the axial flange 64; and a second portion 74 extending radially outward from the first portion. A generally triangular configuration is evident from FIGS. 2 and 5. However, it can be appreciated by those skilled in the art that other configurations for the reinforcing ribs 70 may also be used.

The fan guard 60 further includes a plurality of spaced fan guard ribs 80 each connected at an inner end to the inner housing member 62. With particular reference to FIG. 5, at least some fan guard ribs 80 have a first section 82 which is connected to and extends radially outward from at least one of the axial flange 64 and the radial flange 66 and a second section 84 which extends radially outward from the first section 82. As is also evident from FIG. 5, at least some fan guard ribs 80 have a first section 83 which is connected to and extends radially outward from the radial flange 66 and a second section 85 extending axially from the first section 83 and approximately parallel to the axial flange 64 of the inner housing member 62. The second section 85 has an end connected to a section in the same plane as the second section 84. In other words, the fan guard ribs having sections 83 and 85 are indented from the fan guard ribs having sections 82, as may be also seen from FIG. 3. The indented portion of the fan guard accommodates the arms 46 of the mounting bracket 40.

With reference again to FIG. 5, the reinforcing ribs 70 and at least some of the fan guard ribs 80 are contiguous. Particularly, the second section 84 of the fan guard rib 80 extends away from the second portion 74 of the reinforcing rib 70. It should be evident from FIG. 2 that the reinforcing ribs 70 are spaced from each other by one or more fan guard ribs 80 so that the reinforcing ribs extend at relatively equal intervals around the inner housing member 62 for the full extent of the axial flange 64 thereof.

Figure 4:
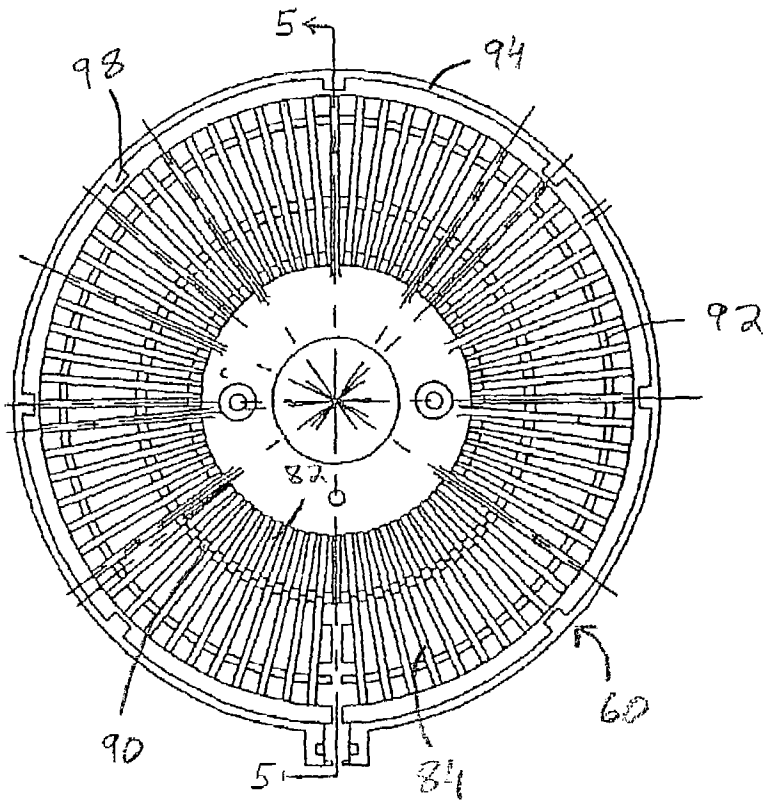
FIG. 4 is a rear elevational view of a fan guard used in the fan assembly of FIG. 1.

The fan guard 60 also comprises at least one circumferential support rib to further stiffen the fan guard 60. In one embodiment of the present invention and as illustrated in FIG. 4, a first support rib 90 is provided and extends circumferentially around the inner housing member 62 and is secured to the plurality of fan guard ribs 80. A second support rib 92 can also be provided. The second rib can be concentrically spaced from the first support rib 90. The second support rib 92 is secured to at least one of the first section 82 and the second section 84 of the fan guard ribs 80. It can be appreciated by those skilled in the art that the fan guard 60 may include additional support ribs depending on the requirements needed for the end use of the electric fan.

With reference particularly to FIG. 3, a rim 94 extends circumferentially around the plurality of the fan guard ribs 80 and is connected to an outer end of the second section 84 of each fan guard rib. The rim 94 includes a first portion 96 extending radially from the second section 84 and at least one second portion 98 extending axially from the first portion 96. The first and second portions together form a generally L-shaped channel. The fan grill 10 is received in the L-shaped channel. Thus, the rim 16 of the fan grill 10 lies in a plane spaced from a plane of the radial flange 66 of the inner housing member 62. The rim 94 further includes two adjacent mounting flanges 100 extending radially from the first portion 96. The mounting flanges 100 have apertures adapted to receive a fastener 102. The flanges are spaced from each other to allow the fan grill 10 to be mounted to the fan guard 60. Thereafter, the fastener can be tightened to draw the mounting flanges closer together for securing the fan grill 10 to the rim 94.

Typically, the fan guard 60 can be made of a conventional polymer material such that the fan guard is formed in a single molding operation. However, alternative materials, including metallic materials such as aluminum, can be used to form same. In addition, composite materials, such as carbon fiber reinforced resin material, can be used to form a particularly strong fan guard.

To assemble the components of the electric fan A, the electric motor 50 is first secured to the mounting assembly 30 by extending the motor assembly bolts 54 through the mounting apertures 48 located on the two spaced arms 46 of the bracket 40. The axial flange 64 of the fan grill 60 is then slid over a portion of the electric motor body 52. Thus, a portion of the electric motor 50 will extend through the aperture 69 in the radial flange 66 and the motor assembly bolts 54 will extend through the mounting apertures 68. Nuts 56 are then threaded on the motor assembly bolts 54 thereby securing the mounting assembly 30 and fan guard 60 to the electric motor 50. Next, boss 22 of the fan blade assembly 20 is attached the output shaft 58 of the electric motor 50 in a manner well known in the art. Finally, the fan grill 10 is received in the L-shaped channel of the rim 94 and secured therein by drawing the mounting flanges 100 together. Afterwards, the electric fan A can be mounted in a vehicle.

In accordance with the present disclosure, the fan guard assembly 60 comprises an inner housing member 62 including a semicircular axial flange 64 encompassing the motor body 52 and a radial flange 66 having apertures 68 through which the motor case bolts 54 are secured. The axial flange generally extends through an arc greater than one hundred eighty degrees (180°) such that all flexural forces are limited by the motor body. The increased strength and rigidity of the fan guard assembly is enhanced by crush ribs or flats 65 formed on an inner surface of the axial flange 64 which insure positive contact with the motor body, thereby positively transferring all flexural stresses to the motor body 52. Preferably, the fan grill 10 is not attached to the same plane formed by the radial flange 66 secured by the motor case bolts 54 and is attached farther rearward away from the fan blade assembly 20. The fan guard assembly 60 further comprises reinforcing ribs 70 which extend rearward and forward on the inner housing member 62. The reinforcing ribs further stiffen the fan guard assembly.

One aspect of the disclosed design resides in the improved retention of the inner housing member 62 on the electric motor body 52 thereby providing a greater resistance to operator handling and vehicle vibration. As such, the possibility of the fan guard assembly 60 coming into contact with the fan blade assembly 20, which could cause portions of the fan blades 26 to break and exit the fan guard, is greatly reduced.

The invention has been described with reference to a preferred embodiment. Obviously, modifications and alterations will occur to others upon reading and understanding the preceding detailed description. It is anticipated that the fan guard discussed herein would have benefits in other applications wherein a rotating member is mounted to a motor. Accordingly, it is intended that the exemplary embodiment be construed as including all such modifications and alterations insofar as they come within the scope of the appended claims or the equivalents thereof.

What is claimed is:

1. A fan guard which utilizes an associated electric motor body for increased support and rigidity, the fan guard comprising:

an inner housing member for mounting to an associated electric motor body wherein the inner housing member includes an axially extending flange which is generally semicircular in cross-section;

a plurality of circumferentially spaced reinforcing ribs each connected at an inner end to the inner housing member, each reinforcing rib extending radially outward therefrom;

a plurality of spaced fan guard ribs connected at an inner end to inner housing member and extending radially outward therefrom; and a rim extending circumferentially around said plurality of fan guard ribs and being connected to an outer end of each of the fan guard ribs.

2. The fan guard of claim 1 wherein the inner housing member is slidingly and axially received over at least a portion of the associated electric motor body.

3. The fan guard of claim 1 wherein the flange extends through an arc greater than one hundred eighty degrees (180°).

4. The fan guard of claim 1 wherein the axial flange includes at least one crush rib for insuring contact with and for positively transferring flexural stresses to the associated electric motor body.

5. The fan guard of claim 4 wherein the radially extending flange includes at least one mounting aperture adapted to receive an associated fastener to secure the inner housing member to the associated motor body.

6. The fan guard of claim 1 wherein the inner housing member further includes a radially extending flange.

7. The fan guard of claim 1 wherein the reinforcing ribs and at least some of the fan guard ribs are contiguous, wherein at least some of the fan guard ribs are located radially outward of said reinforcing ribs.

8. The fan guard of claim 1 further including at least one support rib extending circumferentially around said inner housing member and secured to said plurality of fan guard ribs.

9. The fan guard of claim 1 wherein said inner housing member, said plurality of reinforcing ribs, said fan guard ribs and said rim are of one piece.

10. A fan guard assembly which utilizes an associated electric motor body for increased support and rigidity, the fan guard assembly comprising:

a fan grill;

an inner housing member for mounting to an associated electric motor body, the inner housing member having a radially extending flange;

a plurality of circumferentially spaced reinforcing ribs connected at an inner end to the inner housing member, each rib extending radially outward from the inner housing member;

a plurality of spaced fan guard ribs, each connected at an inner end to at least one of said reinforcing ribs and said inner housing member; and a rim extending circumferentially around said plurality of fan guard ribs and being connected to an outer end of each of the fan guard ribs, wherein the rim includes a first portion extending radially from said outer end of each of said fan guard ribs and a second portion extending axially from a distal end of said first portion, wherein the first and second portions together form a generally L-shaped channel dimensioned to receive said fan grill.

11. The fan guard of claim 10 wherein the inner housing member includes at least one crush rib for insuring contact with and for positively transferring flexural stresses to the associated electric motor body.

12. The fan guard assembly of claim 10 wherein the rim includes adjacent radial flanges extending from said first portion.

13. The fan guard assembly of claim 12 wherein each radial flange includes an aperture adapted to receive an associated fastener to draw the adjacent flanges closer together for securing said fan grill to the rim.

14. The fan guard assembly of claim 10 wherein the fan grill is fixedly secured in the L-shaped channel of the outer rim member so that a longitudinal plane of said fan grill is axially spaced from a longitudinal plane of said flange of the inner housing member thereby further stiffening the fan guard assembly.

15. The fan guard assembly of claim 10 further including at least one support rib extending circumferentially around said inner housing member and secured to said plurality of fan guard ribs.

16. A fan guard which utilizes an associated electric motor body for increased support and rigidity, the fan guard comprising:

an inner housing member including a crescent-shaped portion sized to encompass at least a portion of the associated electric motor body, the inner housing member having a radially extending flange;

a plurality of circumferentially spaced reinforcing ribs each connected at an inner end to the inner housing member, each rib extending radially outward from the inner housing member; and a plurality of spaced fan guard ribs each connected at an inner end to at least one of said reinforcing ribs and said inner housing member.

17. The fan guard of claim 16 wherein the inner housing member is slidingly and axially received over at least a portion of the associated electric motor body.

18. The fan guard of claim 16 wherein the crescent-shaped portion includes at least one crush rib for insuring contact with and for positively transferring flexural stresses to the associated electric motor body.

19. The fan guard of claim 16 wherein the radial flange includes at least one mounting aperture adapted to receive an associated fastener to secure the flange to an associated front surface of the associated electric motor body.

20. The fan guard of claim 16 wherein the reinforcing ribs are spaced from each other by at least one fan guard rib.

21. The fan guard of claim 20 wherein at least some of the reinforcing ribs and some of the fan guard ribs are contiguous.

22. The fan guard of claim 21 wherein for the contiguous reinforcing ribs and fan guard ribs, the fan guard ribs are located radially outward of the reinforcing ribs.

23. The fan guard of claim 16 further including at least one support rib extending circumferentially around and transversely to a portion of said plurality of fan guard ribs.

24. The fan guard of claim 16 wherein the inner housing member, the reinforcing ribs and the fan guard ribs are of one piece.

25. A fan guard which utilizes an associated electric motor body for increased support and rigidity, the fan guard comprising:

a generally semi-circular inner housing member sized to encompass and slidingly and axially receive at least a portion of the associated electric motor body, the inner housing member including a radially extending circular flange having at least one mounting aperture adapted to receive an associated fastener to secure the flange to the associated motor body;

a plurality of circumferentially spaced reinforcing ribs connected at an inner end to the inner housing member, each rib extending radially outward from the inner housing member;

a plurality of spaced fan guard ribs each connected at an inner end to at least one of said reinforcing ribs and said inner housing member a rim extending circumferentially around said plurality of fan guard ribs and being connected to an outer end of each of the fan guard ribs, wherein the rim is axially spaced from the inner housing member.

26. The fan guard of claim 25 wherein the generally semi-circular inner housing member includes at least one crush rib for insuring contact with and for positively transferring flexural stresses to the associated electric motor body.

27. The fan guard of claim 25 wherein at least some of the fan guard ribs have a first section lying in a first plane and a second section extending away from the first plane.

28. The fan guard of claim 25 wherein at least some fan guard ribs have a first section lying in a second plane and a second section extending generally normal to the second plane.

29. The fan guard of claim 25 wherein the rim lies in a third plane spaced from the first plane.

30. The fan guard of claim 25 wherein at least one support rib extends circumferentially around said inner housing member and secured to at least one of said first section and second section of the fan guard ribs.

31. The fan guard of claim 30 wherein a second support rib is concentrically spaced from said first support rib.

* * * * *